United States Patent [19]

Cukier et al.

[11] Patent Number: 4,517,072

[45] Date of Patent: May 14, 1985

[54] PROCESS FOR MODIFYING COAL TAR MATERIALS

[75] Inventors: Samuel Cukier, Toronto; Henry A. F. L. Kremer, Thornhill, both of Canada

[73] Assignee: Domtar Inc., Montreal, Canada

[21] Appl. No.: 552,252

[22] Filed: Nov. 16, 1983

Related U.S. Application Data

[63] Continuation of Ser. No. 264,294, May 18, 1981, abandoned.

[51] Int. Cl.[3] ..... C10C 1/18; C10C 3/08

[52] U.S. Cl. ..... 208/45; 208/22; 208/44

[58] Field of Search ..... 208/45, 22

[56] References Cited

U.S. PATENT DOCUMENTS

| | | | |
|---|---|---|---|
| 2,342,524 | 4/1944 | Von Lauer et al. | 208/224 |
| 3,147,205 | 9/1964 | Ohsol | 208/45 |
| 3,490,586 | 1/1970 | Jaisle | 208/45 |
| 3,718,493 | 2/1973 | Joo et al. | 208/41 |
| 3,761,387 | 9/1973 | Wegener | 208/45 |
| 3,779,896 | 12/1973 | Woodle | 208/309 |
| 3,992,281 | 11/1976 | Benade | 208/45 |
| 4,259,171 | 3/1981 | Stadelhofer et al. | 208/45 |
| 4,292,170 | 9/1981 | Simone | 208/254 R |
| 4,405,439 | 9/1983 | Simone | 208/45 |

FOREIGN PATENT DOCUMENTS

| | | | |
|---|---|---|---|
| 1342886 | 9/1972 | U.S.S.R. | 208/45 |

*Primary Examiner*—Delbert E. Gantz
*Assistant Examiner*—Helane Myers

[57] ABSTRACT

The present invention relates to a process for decreasing and modifying the quinoline-insoluble content (Q.I.) of coal-tar materials; and comprises extracting the coal-tar material with a solvent, where the solvent contains at least one of n-methyl-2-pyrrolidone and the wash oil fraction of coal-tar distillate. Pitches with a diminished Q.I. content, lower viscosity and lower average Q.I. particle size, may be prepared from coal-tar materials which have been so treated.

8 Claims, 3 Drawing Figures

PROCESS FOR MODIFYING COAL TAR MATERIALS

This application is a continuation of application Ser. No. 264,294, filed May 18, 1981, now abandoned.

FIELD OF THE INVENTION

The present invention relates to a method of modifying coal-tars. More particularly it relates to a method of decreasing and/or modifying the quinoline insoluble content therein.

BACKGROUND OF THE INVENTION/PRIOR ART

Coal-tar is usually obtained as a by-product of the distillation of coal in coke ovens, e.g. in the manufacture of metallurgical coke. It comprises a mixture of a number of hydrocarbon compounds which can be separated by distillation of the tar. Pitch, which is the residue in the still following such a distillation is a viscuous material which softens and flows when heated. Pitches are conventionally classified according to their softening points and their solubility in various solvents eg. quinoline, benzene and dimethylformamide. The latter characteristic is usually indicated by the proportion of the pitch which is insoluble in the solvent eg. the proportion of the pitch which is quinoline-insoluble (Q.I.) is a widely-used pitch characteristic.

Much of the Q.I. formation takes place at the high temperature to which the tar is subjected during coke formation, and stays in the pitch residue following distillation. The presence of the Q.I. in the tar or pitch can be tolerated for a limited number of applications; however, in most of the uses, the presence of significant amounts of Q.I. is viewed as an undesirable characteristic of the material. The particulate nature of the Q.I. renders difficult virtually any process which requires the passage of the pitch through small orifices; eg. penetration of pitch is rendered difficult. Additionally, should the Q.I. have a high content of ash-forming impurities, the combustion rate of the carbon body produced by coking (or otherwise carbonizing) the pitch will be significantly increased.

Accordingly, it is an object of this invention to provide a process for decreasing and modifying the quinoline-insoluble content in coal-tar material.

It is also an object of this invention to provide a process for obtaining pitch material with a diminished content of quinoline-insoluble material.

BRIEF DESCRIPTION OF THE INVENTION

In one aspect, the present invention relates to a process for decreasing and modifying the quinoline-insoluble content (Q.I.) of coal-tar material comprising: mixing the coal-tar material with a solvent which contains at least one of n-methyl-2-pyrrolidone and the fraction of a coal-tar distillate which boils between 100° and 350° C., thereby to form a solvent-dissolved fraction and a solvent-undissolved fraction of the coal-tar material, separating the two fractions, where the Q.I. of the coal-tar material is concentrated in the latter fraction; and the solvent-dissolved fraction comprises coal-tar material with a decreased and modified Q.I. Preferably, the process comprises the additional step of recovering the solvent.

In another aspect, the present invention relates to the production of pitch material by the distillation of the aforesaid solvent-dissolved fraction where the pitch has a reduced and modified Q.I.

DETAILED DESCRIPTION OF THE INVENTION

Figure 1:
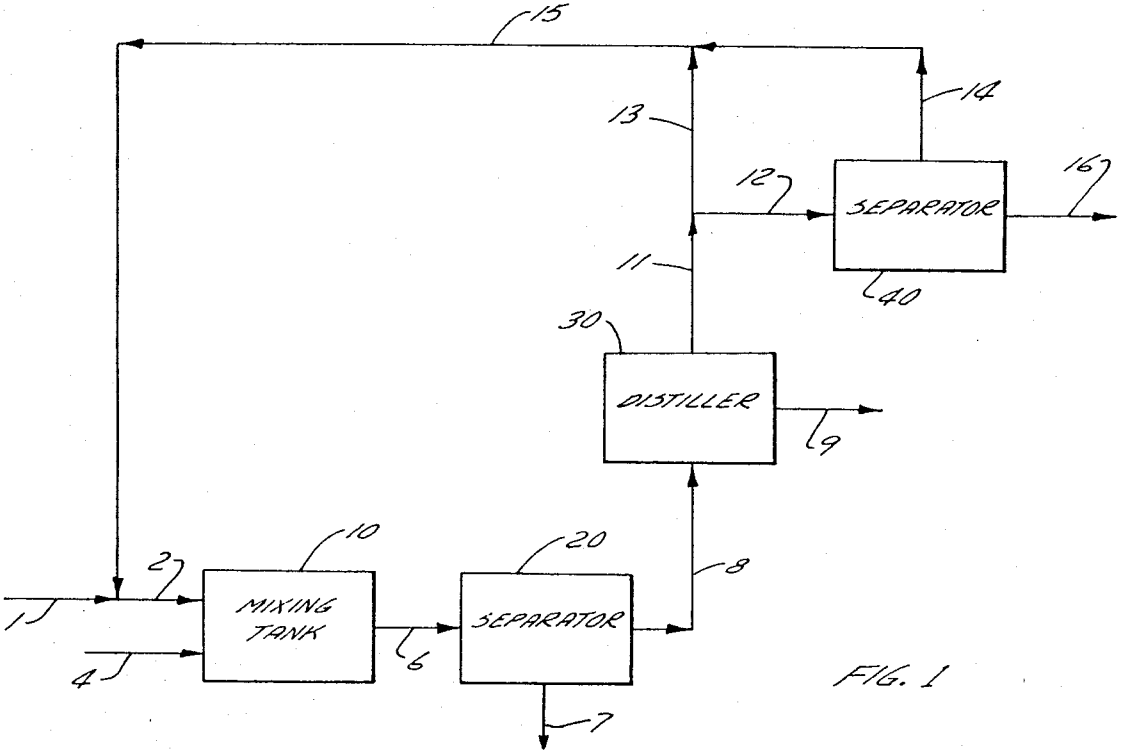
FIG. 1 is a schematic flow diagram which illustrates the steps which an embodiment of this invention entails.

Accordingly, the present invention relates to a process whereby the content of quinoline-insolubles (Q.I.) in coal-tar material can be decreased. The coal-tar material which has been thus treated can be distilled in order to obtain a pitch having a diminished Q.I. Additionally, the Q.I. contained in the pitch so obtained will usually have a size distribution different from a conventionally obtained pitch having the same Q.I. This latter attribute of the present invention is referred to as the "modification" of the Q.I. The present invention additionally relates to a novel coal tar pitch material having a significantly reduced viscosity and a lower average particle size.

Broadly, the process of the present invention comprises a solvent extraction of coal-tar material in order to separate the quinoline-soluble from the guinoline-insoluble components; where the solvent chosen for this procedure contains at least one of n-methyl-2-pyrrolidone and the fraction of the coal-tar distillate which boils between 100° and 350° C., preferably between 200° and 350° C. In the following, the latter solvent will be referred to as wash oil, a term which is widely used in the art. The mixing of coal-tar material with the solvent results in the formation of two fractions which can be substantially separated, viz. the solvent-dissolved and that undissolved in the solvent, with most of the Q.I. being localized in the latter fraction, while the former fraction comprising the coal-tar material has a greatly reduced Q.I. These fractions may be separated by conventional techniques such as filtration, centrifugation, decantation and the like. The solvent-dissolved fraction of the coal-tar material so treated can be distilled to separate the various fractions with different boiling points and obtain a pitch material with a significantly diminished Q.I. The pitch material, thus produced has a number of characteristics and uses that are associated with a low Q.I., a substantially reduced viscosity, and a relatively low average size of particulate matter. The distillation, which serves to separate the higher boiling components from the pitch residue, also serves to separate the n-methyl-2-pyrrolidone from the higher boiling components with which it distils over. The n-methyl-2-pyrrolidone has a lower boiling point than the light boilers container in the distillate and can be separated therefrom. The wash oil fraction of the distillate can be permitted to distil over with the n-methyl-2-pyrrolidone and can equivalently (individually, or in combination with the n-methyl-2-pyrrolidone) be used as a solvent in this solvent extraction process. This will permit some flexibility in the distillation procedure. The n-methyl-2-pyrrolidone and/or the wash oil fraction which will be contained in the distillate can then be recycled for use in the extraction of more coal-tar material.

The amount of solvent employed for this extraction will be partially determined by the viscosity of the resultant coal-tar-solvent mixture required for the separation technique (and which is also dependent upon the temperature of this process) and by the amount required to dissolve substantially all the quinoline soluble material. Typically, the proportion of the solvent in the mixture will usually range from about 20 to 80% of the mixture, ie. the solvent: tar ratio will be in the range 1:4 to 4:1.

Turning now to the single figure (FIG. 1), we note that n-methyl-2-pyrrolidone which is introduced via line 01, can be mixed with recycled solvent which can additionally contain some light boilers and is introduced to the mixing tank 10, via line 02 where it is mixed with the untreated tar which has been introduced to the tank via line 04, at a temperature high enough to facilitate its handling and further processing. The mixture then passes via line 06 to the separation step 20 where the solvent-dissolved fraction and the fraction insoluble in the solvent are separated, possibly by differences in specific gravity or by filtration, as a result of which the former fraction leaves this step via line 08 and the latter fraction via line 07. The former fraction which contains a tar with a depleted Q.I. can be distilled in the distillation step 30 from which the n-methyl-2-pyrrolidone and the light boilers come over as the earlier fractions of the distillate and can be separated from each other, at separation step 40, if so desired or recycled via lines 13 and 15 for use as a solvent in the extraction of subsequent batches of coal-tar material. The pitch residue obtained from this distillation via line 09 will have a substantially reduced viscosity, a lower average particle size of insolubles, in addition to a reduced Q.I. content.

The advantages accuring to the user of this process are many, not the least of which is the extent of the Q.I. removal from the coal-tar which results from the use of this process. Some of the other advantageous features of this process stem from the solvent system used in this process viz. the n-methyl-2-pyrrolidone and/or the light boiling cut of the tar distillate; in particular, the ease with which the solvent can be used, recovered, reused; and the facility with which these operations can be integrated into a conventional pitch production process.

A surprising outcome of this process is the manner in which the viscosity of the pitch and the size distribution of the Q.I. is affected. The size distribution of a pitch derived from an unextracted tar, or one extracted with a solvent different from that of the present invention, is often characterized by a greater degree of particulate agglomeration. The pitch material thus obtained is characterized by a viscosity lower than that of pitches obtained by the distillation of the untreated coal tar. This is particularly important where the particulate size of the pitch is important e.g. in applications such as the impregnation of prebaked electrodes.

The following examples will serve to illustrate the invention.

EXAMPLE 1

This example illustrates how the Q.I. of a conventional coal tar material can be decreased by the present invention using the light boilers of coal tar distillation (wash oil) as the solvent.

A sample of coal-tar having a Q.I. of 6.5%, and representative of the output obtained from steel mills was mixed with wash oil in a tar to wash oil ratio of 3:2. The mixture was filtered using a Buchner funnel and No. 1 analytical filter paper with a moderate vacuum being applied to accelerate the process. The Q.I. of the treated tar was measured. The filtrate was then distilled under atmospheric pressure, and the Q.I. content of the pitch residue determined in accordance with ASTM D2318. The experimental results are summarized in Table 1 below. The above procedure was repeated with two other commercially available coal tar samples having Q.I. values of 7.0 and 23.7% respectively. In each of the cases, the Q.I. in the treated tar was a small fraction of that in the original sample.

A possibly more remarkable outcome which was indicative of the degree to which the process resulted in the Q.I. removal was the low Q.I. content in the pitch residue as compared to the original tar. This is surprising because Q.I. is normally concentrated in the pitch, partly due to a large decrease in the volume, and partly due to some cracking which occurs during the distillation. Nonetheless, in all the cases the Q.I. in the pitch was a small fraction of that in the tar prior to filtration.

The above procedure was repeated with the same three tar samples, but with a tar:solvent ratio of 1:4. The experimental results which are qualitatively substantially the same as the preceding set; are also summarized in Table 1 below.

TABLE 1

| Coal Tar Sample | Tar:Solvent Ratio | Q.I. (%) Untreated Tar | Q.I. (%) (Treated Tar) | Q.I. (%) (Pitch) |
|---|---|---|---|---|
| 1 | 3:2 | 6.5 | 0.02 | 0.3 |
| 2 | 3:2 | 7.0 | 0.5 | 1.0 |
| 3 | 3:2 | 23.7 | 0.7 | 4.5 |
| 1 | 1:4 | 6.5 | 0.5 | 0.5 |
| 2 | 1:4 | 7.0 | 0.03 | 0.5 |
| 3 | 1:4 | 23.7 | 0.3 | 3.0 |

EXAMPLE 2

This example illustrates the use of n-methyl-2-pyrrolidone as the solvent in the extraction of the Q.I. from the tar.

Tar samples identical to those in example 1 were subjected to essentially the same procedure and tests as described above in the preceding Example. The results of these experimental runs which are summarized in Table 2 below follow essentially the same pattern as in the preceding Example. The treated tar has a greatly reduced Q.I. which is also manifested in the low Q.I. content of the pitch residue remaining after the distillation of the tar.

TABLE 2

| Coal Tar Sample | Tar:Solvent Ratio | Q.I (%) Untreated Tar | Q.I. (%) (Treated Tar) | Q.I. (%) (Pitch) |
|---|---|---|---|---|
| 1 | 3:2 | 5.0 | 0.1 | 0.7 |
| 2 | 3:2 | 4.2 | 0.1 | 3.4 |
| 3 | 3:2 | 18.2 | 0.3 | 4.5 |
| 1 | 1:4 | 5.0 | 0.2 | 1.3 |
| 2 | 1:4 | 4.2 | 0.1 | 1.8 |
| 3 | 1:4 | 18.2 | 0.03 | 5.1 |

EXAMPLE 3

This example presents a qualitative comparison of particle sizes of insolubles in tar which has been extracted using a conventional solvent (in this case quinoline), and that which is residual in *pitch* after an extraction of the precursor tar according to the present invention.

Figure 2A:
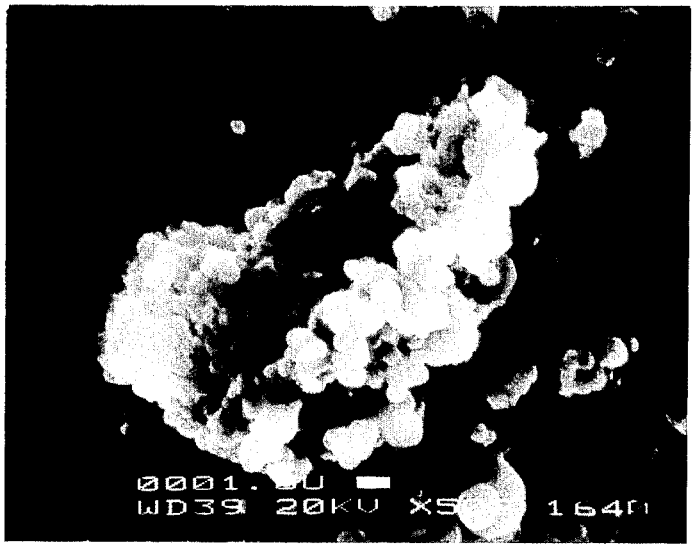
FIG. 2 (FIGS. 2(*a*) and 2(*b*) are scanning electron microscope photographs of the insoluble particulate matter in the tar and pitch respectively.
Figure 2B:
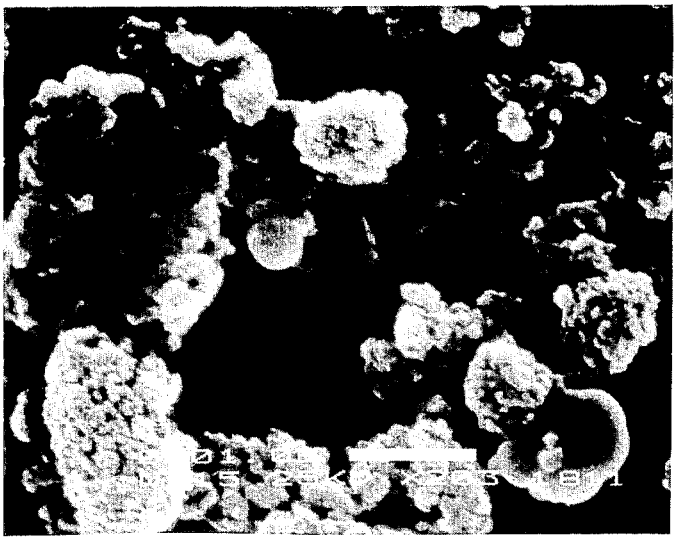

FIG. 2(*a*) is a scanning electron microscope (S.E.M.) photograph of residual tar Q.I. following an extraction using quinoline. FIG. 2(*b*) is a S.E.M. photograph of the insolubles in a *pitch* prepared from an identical tar after extraction with n-methyl-2-pyrrolidone.

It will readily moved that typical particle sizes in the former photograph are greater than about 1 micron, with sizes of the agglomerated particles ranging up to about 4 microns. The particle sizes in the latter photograph (FIG. 2(*b*)) range from less than about 0.1 microns to about 0.5 micron, with the larger agglomerates being about 1 micron in size.

The difference in the particle size distribution is all the more substantial when we note that the particles in latter photograph includes not only the insolubles following the extraction of the tar, but additionally include the "secondary" Q.I. produced during the tar distillation to produce the pitch, where the original Q.I. is concentrated and function as nuclei for the growth of Q.I. particles.

The above described procedure can be subjected to a great variety of modifications which will be evident to those skilled in the art and which fall within the scope of the appended claims.

We claim:

1. In a process to obtain a pitch material from an undistilled coal tar material containing the mixture of hydrocarbon compounds which are normally separated by tar distillation, and normally including light oil, carbolic oil, wash oil and the pitch forming components, the improvement which consists essentially in decreasing the content of guinoline-insolubles (Q.I.) of said pitch material prior to distilling said coal-tar material by mixing said undistilled coal-tar material with a solvent which consists of at least one of the following: n-methyl-2-pyrrolidone and the fraction of a coal-tar distillate which boils between 100° and 350° C., said mixing being carried out at a temperature such as to form a solvent-dissolved fraction and a solvent-undissolved fraction, separating and removing said solvent-undissolved fraction of said undistilled coal-tar material, said undissolved fraction containing Q.I. having a high content of ash-forming impurities and using said solvent-dissolved fraction to produce coal-tar material with a decrease Q.I. and lower impurities by distilling said solvent-dissolved fraction of said undistilled coal-tar material so as to obtain from said solvent-dissolved product a pitch material, having a lower Q.I. and lower impurities than pitch material typically obtained by the conventional distillation of said coal-tar material.

2. The process as defined in claim 1, wherein said distillation additionally serves to separate said solvent from said solvent-dissolved fraction.

3. Process as defined in claim 2 wherein said separated solvent is used in the extraction of additional coal tar material.

4. The process as defined in claim 1, wherein the ratio of said solvent to said coal-tar material ranges from about 4:1 to about 1:4.

5. The process as defined in claim 1, wherein said mixing and separation steps are carried out at a temperature in the temperature range of 75°–95° C.

6. The process as defined in claim 1, wherein said separation is carried out by filtration of said mixture.

7. The process as defined in claim 1, wherein said separation is carried out by centrifugation of said mixture.

8. The process as defined in claim 1, wherein said separation is a gravity separation.

* * * * *